US008735757B2

(12) United States Patent
Noisette et al.

(10) Patent No.: US 8,735,757 B2
(45) Date of Patent: May 27, 2014

(54) SWITCH UNIT AND CIRCUIT BREAKER FOR A MEDIUM VOLTAGE CIRCUIT

(75) Inventors: Philippe Noisette, Sergy (FR); Yoann Alphand, Fegersheim (FR); Philippe Häberlin, Troinex (FR); Marc Blanc, Lausanne (CH)

(73) Assignee: ABB Technology AG, Zurich (CH)

( * ) Notice: Subject to any disclaimer, the term of this patent is extended or adjusted under 35 U.S.C. 154(b) by 444 days.

(21) Appl. No.: 13/086,847

(22) Filed: Apr. 14, 2011

(65) Prior Publication Data

US 2011/0253676 A1 Oct. 20, 2011

(30) Foreign Application Priority Data

Apr. 16, 2010 (EP) ..... 10160116

(51) Int. Cl.
*H01H 33/20* (2006.01)
*H01H 9/38* (2006.01)

(52) U.S. Cl.
USPC ..... 218/36; 218/148; 218/151

(58) Field of Classification Search
CPC ..... H01H 9/36; H01H 9/38; H01H 33/04; H01H 33/10; H01H 9/20
USPC ..... 218/9–17, 34–40, 148–157; 335/132, 335/201, 202
See application file for complete search history.

(56) References Cited

U.S. PATENT DOCUMENTS

| | | | | |
|---|---|---|---|---|
| 5,744,772 | A * | 4/1998 | Fasano | 218/40 |
| 6,194,984 | B1 * | 2/2001 | Kappel et al. | 335/132 |
| 6,631,058 | B1 * | 10/2003 | Mallonen et al. | 218/158 |

FOREIGN PATENT DOCUMENTS

| | | | |
|---|---|---|---|
| EP | 1 876 618 | A1 | 1/2008 |
| GB | 972 665 | A | 10/1964 |
| GB | 991 926 | A | 5/1965 |
| GB | 1 179 736 | A | 1/1970 |
| JP | 49-074459 | B2 | 7/1974 |
| JP | 01-166434 | A | 6/1989 |
| JP | 2005-216807 | A | 8/2005 |

OTHER PUBLICATIONS

English language translation of the First Office Action dated on Oct. 23, 2012, issued by the Japanese Patent Office in the corresponding Japanese Application No. 2011-092233. (3 pages).
Search Report issued on Sep. 22, 2010, by European Patent Office for Application No. 10160116.9.

* cited by examiner

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A switch unit 200 for a voltage circuit breaker that includes a first switch contact 202*a* and a second switch contact 202*b*. The first switch contact 202*a* is movable between a first position in which the first switch contact 202*a* contacts the second switch contact and a second position in which the first and second switch contacts 202*a*, 202*b* are separated from each other. Further, a positioning element to position an arc chute 100 on the switch unit. The arc chute 100 includes at least two stacks 102, 106 of a plurality of substantially parallel metal plates 104, 104*a*, 104*b*, . . . , 104*n*, 108, 108*a*, 108*b*, . . . , 108*n*. The switch unit includes a first connection device 120, 230*a* capable to electrically connect the first switch contact 202*a* to a predetermined metal plate 104*a* selected of the most proximal 25% metal plates of the first stack 102. A second connection device 122*a* 122*b*, 230*b* capable to electrically connect the second switch contact to a predetermined metal plate 108*a* selected of the most proximal 25% metal plates of the second stack 106.

15 Claims, 3 Drawing Sheets

SWITCH UNIT AND CIRCUIT BREAKER FOR A MEDIUM VOLTAGE CIRCUIT

RELATED APPLICATION

This application claims priority under 35 U.S.C. §119 to European Patent Application No. 10160116.9 filed in Europe on Apr. 16, 2010, the entire content of which is hereby incorporated by reference in its entirety.

FIELD

The present disclosure relates to a switch, such as a switch unit for a medium voltage circuit breaker.

BACKGROUND INFORMATION

Exemplary embodiments of the present disclosure relate to a circuit breaker. Circuit breakers or air circuit breakers are used in a direct current (DC) circuit on railway vehicles. For example, such high speed DC circuit breakers may switch direct currents with more than 500 Volt and 5000 Ampere.

EP 1 876 618 A1 discloses an adaptable arc-chute for a circuit breaker that includes a plurality of arc chute units connected in series, and a switch which is connected in parallel with a part of the arc-chute units to bypass said part of the arc chute units when in a closed position.

In known circuit breakers, the horns, which are connected to the switch contacts, are used. The horns guide an arc into an arc chute, however the feet of the arcs remain on the horns during the arcing time. For example, the arc heats up the horns, which immediately start to evaporate and generate gas. The horns wear-out and should be changed after a certain number of operations. Thus, the horns are exchanged regularly before the end of the lifetime of the circuit breaker. The horns, however, can be difficult to exchange. Further, a lot of gases can be generated because of the heat concentration. For example, most of the gases can be concentrated in a limited volume, close to the switch contacts. These gases can generate plasma and a re-ignition may occur. It can be difficult to exchange the horns of the circuit breaker.

SUMMARY

A switch unit for a circuit breaker comprising a first switch contact, a second switch contact, wherein the first switch contact is movable between a first position in which the first switch contact contacts the second switch contact and a second position in which the first and second switch contacts are separated from each other. A positioning element to position an arc chute on the switch unit, wherein the arc chute comprises at least two stacks of a plurality of substantially parallel metal plates. A first connection device that electrically connects the first switch contact to a predetermined metal plate selected of a most proximal 25% metal plates of the first stack. A second connection device capable to electrically connect the second switch contact to a predetermined metal plate selected of the most proximal 25% metal plates of the second stack.

BRIEF DESCRIPTION OF THE DRAWINGS

The above recited features of the present disclosure are discussed with reference to embodiments. The accompanying drawings relate to exemplary embodiments of the disclosure and are described in the following.

DETAILED DESCRIPTION

Figure 1:
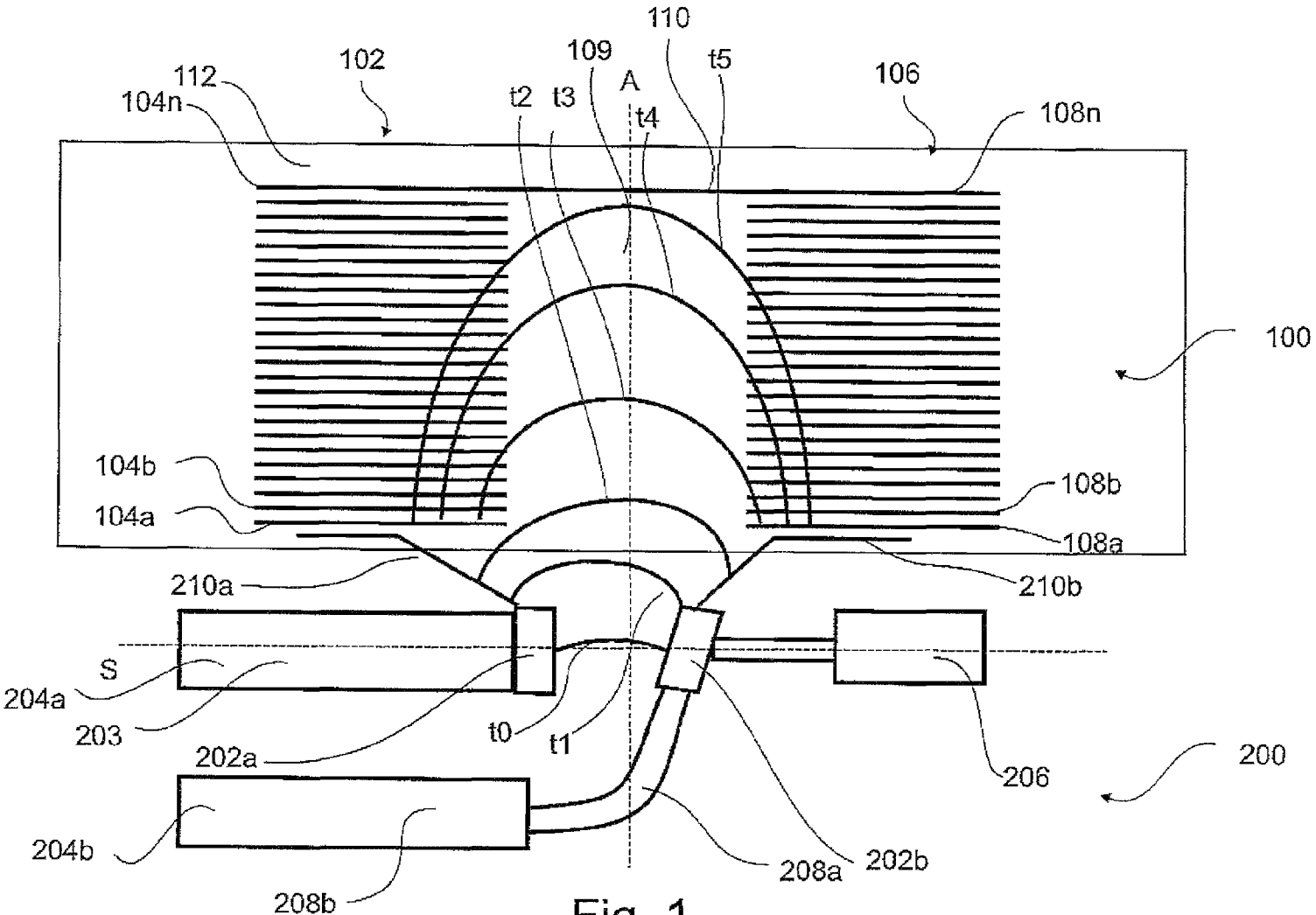
FIG. 1 illustrates a side view of a circuit breaker with open switch contacts in accordance with an exemplary embodiment.

An object of the exemplary embodiments of the present disclosure is to provide a switch unit and a circuit breaker for a medium voltage circuit that has lower usage of the horns and a longer lifetime of the switch unit.

According to an aspect of the present disclosure, a switch unit for a DC medium voltage circuit breaker includes a first switch contact and a second switch contact. The first switch contact is movable between a first position in which the first switch contact contacts the second switch contact and a second position in which the first and second switch contacts are separated from each other. A positioning element to position an arc chute is also included on the switch unit. The arc chute includes at least two stacks of a plurality of substantially parallel metal plates. A first connection device for electrically connecting the first switch contact to a predetermined metal plate selected of the most proximal 25% metal plates of the first stack, and a second connection device for electrically connecting the second switch contact to a predetermined metal plate selected of the most proximal 25% metal plates of the second stack. Each stack can have a proximal end which is adapted and/or capable to be disposed towards of the switch unit.

In an exemplary embodiment, the circuit breaker can be an air DC circuit breaker, in which each current interruption generates an arc. An arc can start from a contact separation and can remain until the current is zero. In exemplary embodiments, to cut out DC currents, high speed DC circuit breakers can build up DC voltages that are higher than the net voltage. To build up a DC voltage, air circuit breakers can use an arc chute or extinguish chamber in which metallic plates can be used to split arcs into several partial arcs. The arc can be lengthened and gases used to increase the arc voltage by a chemical effect, for example, by evaporation of plastic or another material.

Thus, a circuit breaker can be provided which has horns having a longer lifetime. The predetermined metal plates of the first stack and the second stack can have the same potential as the respective first and second switch contacts. For example, the level 0 (zero) metal plates or the predetermined metal plates of the arc chute can be connected with equipotential connections, for example electrical connections, to the switch contacts. Once the arc feet have jumped on the level 0 or the predetermined metal plates of the respective stacks, the current flows through the equipotential connection. The switch contacts and the horns can be cooler than in prior circuit breakers because the arcs, (e.g., arc feet), are faster transferred from the horns to the predetermined metal plates or to the level 0 of the arc chute. Further, the arc feet have a bigger distance from each other.

Further, the arc chute can be more easy and faster to exchange than the horns, so that a longer lifetime of the horns would lead to a shorter maintenance of the arc chute. This can be important in case the arc chute is used on a vehicle, for example a train. According to an embodiment, the lifetime of the horns is about the same as the lifetime of the switch contacts and the driving unit for moving the switch contact of the circuit breaker. Thus, during maintenance, only the arc chute can be exchanged if they are used.

In an exemplary embodiment, preferably the predetermined metal plate of the first stack can be selected of, for example, the most proximal 20%, or the most proximal 10%, for example, metal plates of the first stack.

In another exemplary embodiment, preferably the predetermined metal plate of the second stack can be selected, for example, of the most proximal 20%, or the most proximal 10%, for example, metal plates of the second stack.

In an exemplary embodiment, which can be combined with other embodiments disclosed herein, the first connection device and/or the second connection device can be disposed such that the arc feet of an arc created between the first switch contact and the second switch contact in an interruption operation are transferred to the predetermined metal plates of the first stack and the second stack.

In an exemplary embodiment, the positioning element is a screw, a hinge, a bolt, a stop, a bar, or other suitable component as desired. For example, the positioning element can be used for connecting the arc chute to the switching unit.

In an exemplary embodiment, the second switch contact moves substantially along a moving direction.

In another exemplary embodiment, the switch unit can include a first horn, comprised of steel or iron, and electrically connected to the first switch contact. The first switch contact can be adapted to guide a first foot of an electric arc to the arc chute, such as, the first stack of the arc chute. A second horn, comprised of steel or iron, can be electrically connected to the second switch contact adapted to guide a second foot of the electric arc to the arc chute, such as the second stack of the arc chute.

In an exemplary embodiment, which can be combined with other exemplary embodiments of the present disclosure, the first horn and/or the second horn have a fixed first end in the direction of the first/or second switch contact, and a resilient second end opposite to their respective first end. The second end is movable in direction of the arc chute to be mounted on the switch unit.

In another embodiment, the first connection device can be disposed on the first horn, and/or the second connection device can be disposed on the second horn. For example, the first connection device can be disposed at the second end of the first horn and/or the second connection device is disposed at the second end of the second horn.

In an exemplary embodiment, which can be combined with other exemplary embodiments of the present disclosure, the first connection device and/or the second connection device can be a graphite conductor, that is fixed to the respective first or second horn.

In another exemplary embodiment, the second end of the first horn and/or the second end of the second horn can be biased in a direction of the stacks of the arc chute adapted to be mounted on the switch unit.

In an exemplary embodiment, which can be combined with other exemplary embodiments of the present disclosure, the first connection device can be a first metallic connector, such as a bar, and/or the second connection device can be a second metallic connector, such as a metallic wire.

For example, in another exemplary embodiment, the predetermined metal plate of the first stack and/or the predetermined metal plate of the second stack can be the most proximal metal plate of the respective stack in the direction of the switch unit.

In an exemplary embodiment, each of the first stack and the second stack has a distal end, for example, opposite to the proximal end. A metal plate is at the distal end, for example, at the most distal metal plate of the first stack is electrically connected to a metal plate at the distal end, in particular the most distal metal plate, of the second stack.

In an exemplary embodiment, a metal plate preferably selected from the most distal 25%, for example, or 10% for example, metal plates of the first stack can be electrically connected to a metal plate preferably selected of the most distal 25%, for example, or 10% of the metal plates of the second stack, for example by a metal bar.

For example, in an exemplary embodiment, the switch unit can be provided for a DC current having more than 600 A.

Further, an exemplary embodiment of the present disclosure includes a circuit breaker for a medium voltage circuit having a switch unit and an arc chute.

In an exemplary embodiment, the metal plates of each stack of the arc chute are substantially equal.

In an exemplary embodiment, which may be combined with other exemplary embodiments disclosed herein, the stacks can be substantially orthogonal to the moving direction of the first and/or second switch contact.

For example, the predetermined metal plate of the first stack and/or the predetermined metal plate of the second stack can have a copper coating.

In another exemplary embodiment, the metal plates of the first stack and/or the second stack are manufactured from steel.

In addition, an exemplary embodiment, which may be combined with other exemplary embodiments disclosed herein, the circuit breaker can be a circuit breaker for a traction vehicle, for example, a railway vehicle, a tramway, a trolleybus and the like.

Figure 2:
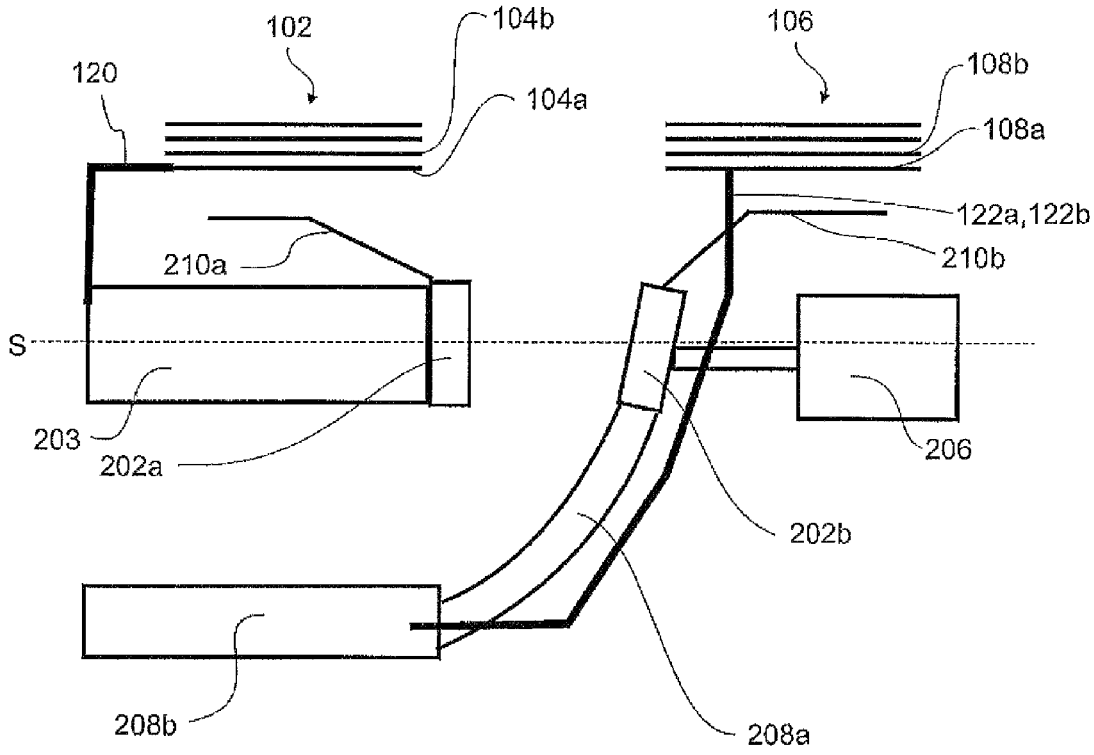
FIG. 2 illustrates a side view of a portion of switch unit of a circuit breaker in accordance with an exemplary embodiment.
Figure 3:
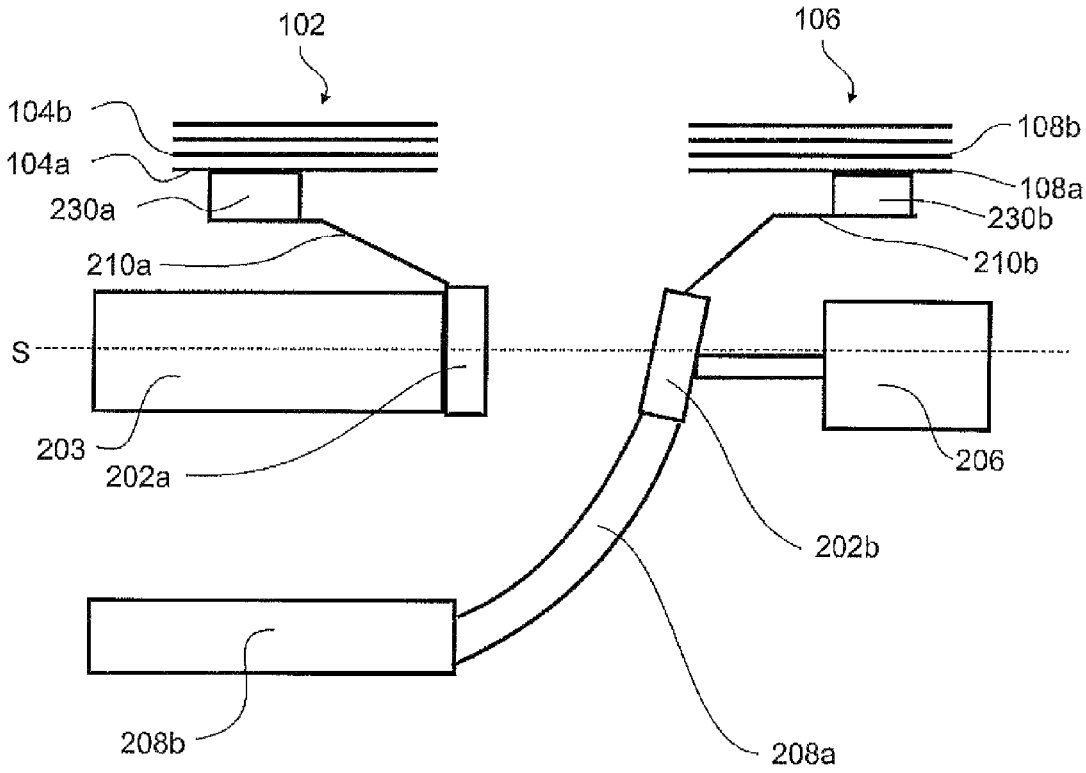
FIG. 3 illustrates a side view of a switch unit in accordance with an exemplary embodiment.

Reference will now be made in detail to the various embodiments, one or more examples of which are illustrated in the figures as follows:

FIG. 1 illustrates a side view of a medium voltage direct current (DC) circuit breaker, in accordance with an exemplary embodiment;

FIG. 2 illustrates a portion of a circuit breaker for medium voltage in a perspective view in accordance with an exemplary embodiment; and FIG. 3 illustrates a side view of a connection between switch controls and the lowest metal plates in accordance with an exemplary embodiment.

Each example is provided by way of explanation, and is not meant as a limitation of the disclosure. Within the following description of the drawings, the same reference numbers refer to the same components. Generally, only the differences with respect to individual embodiments are described.

FIG. 1 illustrates a side view of a medium voltage direct current (DC) circuit breaker in accordance with an exemplary embodiment. The circuit breaker is an air circuit breaker working at medium voltages, for example, between 500V and 3600V. The circuit breaker includes an arc chute 100 and a switch unit 200. The arc chute includes a first stack 102 of metal plates 104*a*, 104*b*, . . . , 104*n* and a second stack 106 of metal plates 108*a*, 108*b*, . . . , 108*n*.

The metal plates 104*a*, 104*b*, . . . , 104*n*, 108*a*, 108*b*, . . . , 108*n* of the first and the second stack 102, 106 are substantially equal. An arc space 109 can be disposed between the first stack 102 and the second stack 106 of metal plates. When the circuit breaker is opened, an arc mounts in the arc space 109.

The arc chute can be symmetric to an axis traversing the arc space 109 which is parallel to the stacking direction of first stack 102 of metal plates and the second stack 106 of metal plates. Further, the top level metal plate or most distal metal plate 104*n* of the first stack 102 can be electrically connected to the top level metal plate or most distal metal plate 108*n* of the second stack 106 with a connection bar 110. Thus, the top level metal plate 104*n* of the first stack can be at the same electrical potential as the top level metal plate 108*n* of the second stack 106.

The lowest metal plate or level zero metal plate 104*a* of the first stack 102 and the lowest metal plate or level zero metal plate 108*a* of the second stack 106 can be the closest metal plates of the respective stacks 102, 106 with respect to the switch unit 200. Hence, the lowest metal plates or most proximal metal plates 104*a*, 108*a* and the top level plates 104*n*, 108*n* are disposed on opposite ends in stacking direction of the respective stack 102, 106 of metal plates.

Each stack 102, 106 can include about 36 metal plates 104*a*, 104*b*, . . . 104*n*, 108*a*, 108*b*, . . . 108*n*. In an exemplary embodiment, each stack may eventually include more than 36 metal plates. The number of metal plates can depend on the arcing voltage respectively the nominal current that is switched by the circuit breaker.

The arc chute 100 is disposed in a casing having at least one side wall 112. The arc chute 100 with its casing can be separated from the switch unit 200. Thus, the maintenance time can be reduced.

The switch unit 200 includes a first switch contact 202*a*, which can be electrically connected to an electric network or a load by a first switch contact terminal 204*a*. The first switch contact 202*a* can be connected with a first switch contact bar or bus bar 203 to the first switch contact terminal 204*a*, wherein the first switch contact bar 203 can include the first switch contact terminal 204*a*. The first switch contact 202*a* can be fixed to a first end of the first switch contact bar 203, and the first switch contact terminal 204 can be disposed at a second end of the first switch contact bar 203 opposite to the first end.

Further, the switch unit 200 includes a second switch contact 202*b*. The second switch unit can be moved by a driving unit 206 in a moving direction S, to move the second switch contact 202*b* from a first position in which the first switch contact 202*a* can be in physical contact with the second switch contact 202*b* and a second position in which the first switch contact 202*a* is separated from the second switch contact 202*b*. The second position is shown in FIG. 1. The second switch contact 202*b* can be connected via a second switch contact terminal 204*b* to an electrical network or the load. The second switch contact 202*b* can be electrically connected to the second switch contact terminal 204*b* by a flexible conductor 208*a* and a second switch contact bar 208*b*, wherein the flexible conductor 208*a* can be connected to a first end of the second switch contact bar 208*b*. the second switch contact terminal 204*b* can be disposed at a second end of the second switch contact bar 208*b*, wherein the second end can be opposite to the first end of the second switch contact bar 208*b*.

The arc space 109 can be disposed above the first and second switch contact in operation of the circuit breaker, when the circuit breaker is in closed position, i.e. the first switch contact 202*a* contacts the second switch contact 202*b*. Further, the stacking direction of the stack of metal plates 102, 106 can be substantially parallel to an arc displacement direction A, which is substantially orthogonal to the moving direction S. The stacking direction or arc displacement direction A corresponds to a direction in which the arc extends into the arc chute. The metal plates 104*a*, 104*b*, . . . , 104*n*, 108*a*, 108*b*, . . . , 108*n* and the connection bar 110 can be substantially parallel to the moving direction S.

A first horn 210*a* can be fixed to the first contact 202*a* to guide a foot of an arc to the metal plates 104*a*, 104*b*, . . . 104*n*, for example, to the lowest metal plate 104*a*, of the first stack 102 of the arc chute 100. Further, the switch unit 200 can be provided with the second horn 210*b* which is disposed, such that the arc having foot at the second switch contact 202*b* jumps to the horn 210*b* and moves to the metal plates 108*a*, 108*b*, . . . , 108*n*, for example, to the lowest metal plate 108*a*, of the second stack 106.

The lowest metal plate 104*a* of the first stack 102 and the lowest metal plate 108*a* of the second stack 106, respectively, can be electrically connected to the first switch contact 202*a* and the second switch contact 202*b*. As a result an arc foot of an arc created by interrupting a current can jump from the first and second horns 210*a*, 210*b* onto the lowest metal plates 104*a*, 108*a*. Once, the respective arc foot has jumped to the lowest metal plates, current flows through a respective equipotential connection, which will be explained here-below. In exemplary embodiment, the horns are not heated up by the arcs and thus do not evaporate. Further, the horn wear out can be reduced such that the horns, for example the first horn 210*a*, and a second horn 210*b* can withstand the life time of the circuit breaker. The heat dissipation can be increased once the arc has jumped onto the lowest metal plates, and less gas is generated close to the switch contacts. A heat concentration close to the switch contacts can be reduced, such that the risk of a plasma generation and recognition phenomenal is reduced.

FIG. 1 shows a side view of the circuit breaker in the open state, in which the first switch contact 202*a* is separated from the second switch contact 202*b*. As shown in FIG. 1 an arc expansion within the arc chute 200, for example, the arcs at different moments after the opening of the switch by moving the second switch contact 202*b* away from the first switch contacts 202*a*.

At a first time, t0, after the contact separation of the first switch contact 202*a* and the second switch contact 202*b* the arcing starts.

At t1, the arc, or one foot of the arc, leaves one of the first or second switch contacts 202*a*, 202*b*, and jumps to the horn 210*a*, 210*b* of the respective switch contact 202*a*, 202*b*. This can happen either first on the fixed, e.g., the first switch contact 202*a*, or on the moving contact, e.g., the second switch contact 202*b*. At t2, the arc leaves the second switch contact. Then, the arc feet are located on first horn 210*a* and the second horn 210*b* respectively.

At t3 the arc feet jump on the respective level zero or lowest metal plates 104*a*, 108*a* and the arc continues to climb within the arc chute. At this stage, several little arcs can be generated between respective adjacent metal plates of the first and second stack 102, 104.

At t4 the arc is established on the lowest metal plates 104*a*, 108*a* of the first and second stack 102, 106 respectively and continues to climb within the arc chute, for example, the arc space 109. Finally, at t5 the arc is fully elongated having reached the top of the arc chute, so that the maximum voltage is built. The voltage built up by the arc starts at t0, increases from t1 to t4, and reaches its maximum value approximately at t5. The sequence can be for example influenced by the magnetic field generated by the current, for example for currents greater than 100 A, a chimney effect due to hot gases, for example for currents lower than 100 A, and/or the mechanical behavior of the circuit breaker, for example the velocity of the second switch contact 202*b*.

In an exemplary embodiment, the arc remains present until the current is zero, then the arc is naturally extinguished. The arcing time is proportional to the prospective short circuit current in time constant of the circuit, the current level when opening, the specified voltage to be built up for cutting the contact velocity, for example of the second switch contact, the geometrical circuit breaker design, for example the chimney effect, and/or the material used which has influence on the gas created in the arc chute or the circuit breaker.

FIG. 2 illustrates a portion of a circuit breaker for medium voltage in a perspective view in accordance with an exemplary embodiment. The same features are designated with the same reference numbers as in FIG. 1. As shown in FIG. 2, the circuit breaker is in an open state. Further, the lowest metal plate 104*a* of the first stack 102 is connected via plate connection bar 120 to the first switch contact bar 203, for example, at the second end of the first switch contact. Thus, the lowest metal plate 104*a* of the first stack 102 can have the same electrical potential as the first switch contact 202*a*. The first metal plate can be releasably connected to the plate connection bar 120, and the plate connection bar 120 can be releasably connected, for example by a screw, to the first switch contact bar 203. The first switch contact 202*a* can also be electrically connected in another way to the first metal plate 104*a* of the first stack 102. However, the lowest metal plate, or a metal plate of the first stack 102 close to the first horn 210*a* can have the same electrical potential as the first horn 210*a* and/or the first contact switch 202*a*.

Further, the second switch contact bar 208*b* and thus the second switch contact 202*b* can be electrically connected by a first plate connection wire 122*a* and a second plate connection wire 122*b* to the lowest metal plate 108*a* of the second stack 106. Thus, the lowest metal plate 108*a* of the second stack 106 can have the same electrical potential as the second switch contact 202*b*. The first and the second plate connection wire 122*a*, 122*b* can be disposed on both sides of the second switch contact 202*b*, such that the drive unit 206 or a rod of the drive unit 206 is disposed between them. In an exemplary embodiment, the first plate connection wire 122*a* and the second plate connection wire 122*b* can be releasably connected to the lowest metal plate 108*a* of the second stack 106 and/or to the second switch contact bar 208*b*. The second switch contact 202*b* can also be electrically connected in another way to the first metal plate 108*a* of the first stack 106. However, the lowest metal plate, or a metal plate of the first stack 106 close to the second horn 210*b* is provided to have the same electrical potential as the second horn 210*b* and/or the second contact switch 202*b*.

In an exemplary embodiment, the lowest metal plate 104*a* of the first stack 102 and/or the lowest metal plate 108*a* of the second stack 106 can be coated with copper. Thus, the heat can more easily dissipate on the respective lowest metal plates 104*a*, 106*a* and rusting of the first metal plates 104*a*, 108*a* can be avoided. In another exemplary embodiment, the metal plates of the first stack and the second stack are fabricated of steel. The first and second horn 210*a*, 210*b* can be fabricated from steel or iron.

The equipotential connection between the switch contacts and the respective lowest metal plates can have the advantage, that the heat dissipation is improved, when the arc has jumped on the lowest metal plates 104*a*, 106*a*. As a result, less gas can be generated close to the contact and breaking capability is increased. In an exemplary embodiment, the horns, in particular the first horn 120*a*, and the second horn 120*b* can withstand the lifetime of the switch unit 200.

FIG. 3 illustrates a side view of a connection between the switch contacts 202*a*, 202*b* and the respective lowest metal plates 104*a*, 108*a*, which can be combined with other embodiments disclosed herein. The same features are designated with the same reference numbers as in the previous drawings.

The first horn 210*a* can be electrically connected with the first switch contact 202*a* and the second horn 210*b* with the second switch contact 202*b*. The first horn 210*a* can have a first end connected to the first switch contact 202*a* and a second, free end opposite to the first end, for example, in the direction of the moving direction S. A first graphite connector 230*a* can be fixed or connected to the second end of the first horn 210*a*. The second horn 210*b* can have a first end in direction of the second switch contact 202*b* in a second, free end opposite to the first end, for example in direction of the moving direction S. A second graphite connector 230*b* can be fixed or connected to the second end of the second horn 210*b*.

In an exemplary embodiment, which can be combined with other embodiments disclosed herein, the first horn 210*a* can be biased in the direction of the metal plates of the first stack 102 and the second horn 210*b* can be biased in the direction of the metal plates of the second stack 106. Thus, when the arc chute is fixed on the switch unit 200, the lowest metal plates 104*a*, 104*b* can push the respective horns 210*a*, 210*b* in the direction of the switch contacts 202*a*, 202*b*. Thus, a reliably electric contact can be established between the switch contacts and the respective lowest metal plates 104*a*, 104*b* of the arc chute.

The written description uses examples to disclose the disclosure, including the best mode, and also to enable any person skilled in the art to make and use the disclosure. While the disclosure has been described in terms of various specific embodiments, those skilled in the art will recognize that the disclosure can be practiced with modifications within the spirit and scope of the claims. Especially, mutually nonexclusive features of the embodiments described above may be combined with each other. The patentable scope of the disclosure is defined by the claims, and may include other examples that occur to those skilled in the art. Such other examples are to be within the scope of the claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A switch unit for a circuit breaker comprising:

a first switch contact;

a second switch contact, wherein the first switch contact is movable between a first position in which the first switch contact contacts the second switch contact and a second position in which the first and second switch contacts are separated from each other;

a positioning element to position an arc chute on the switch unit, wherein the arc chute comprises at least two stacks of a plurality of substantially parallel metal plates;

a first connection device that electrically connects the first switch contact to a predetermined metal plate selected of a most proximal 25% metal plates of the first stack;

a second connection device capable to electrically connect the second switch contact to a predetermined metal plate selected of the most proximal 25% metal plates of the second stack;

a first horn electrically connected to the first switch contact, wherein the first switch contact is adapted to guide a first foot of an electric arc to the arc chute; and a second horn electrically connected to the second switch contact adapted to guide a second foot of the electric arc to the arc chute, wherein at least one of the first horn and the second horn have a fixed first end in the direction of the at least one first and second switch contact, and a resilient second end opposite to their respective first end, wherein the second end is movable in the direction of the arc chute to be mounted on the switch unit.

2. The switch unit according to claim 1, wherein the second switch contact is movable substantially along a moving direction (S).

3. The switch unit according to claim 1, wherein the first connection device is disposed on the first horn, and the second connection device is disposed on the second horn, and wherein the first connection device is disposed at the second end of the first horn and the second connection device is disposed at the second end of the second horn.

4. The switch unit according to claim 3, wherein each of the first connection device and/or the second connection device is a graphite conductor.

5. The switch unit according to claim 1, wherein the first connection device is a first metallic connector, and the second connection device is a second metallic connector.

6. The switch unit according to claim 1, wherein the predetermined metal plate of the first stack and the predetermined metal plate of the second stack are the most proximal metal plates of a respective stack in the direction of the switch unit.

7. The switch unit according to claim 1, wherein the first stack and the second stack each have respective distal ends, and wherein a metal plate at the distal end, of the first stack is electrically connected to a metal plate at the distal end, of the second stack.

8. The switch unit according to claim 1 for a DC current having more than 600 A and operating at a net voltage level having more than 500V.

9. The switch unit for a circuit breaker according to claim 1;

wherein the circuit breaker is for a medium voltage circuit.

10. The switch unit according to claim 9, wherein the metal plates of each stack of the arc chute are substantially equal.

11. The switch unit according to claim 9, wherein the stacks of metal plates are substantially orthogonal to a moving direction (S) of the first and/or second switch contact.

12. The switch unit according to claim 1, wherein the predetermined metal plate of the first stack and the predetermined metal plate of the second stack have a copper coating.

13. The switch unit according to claim 1, wherein the first switch contact guides the first foot of an electric arc to the first stack of the arc chute, and wherein the second switch contact guides the second foot of an electric arc to the second stack of the arc chute.

14. The switch unit of claim 5, wherein the first metallic connector is a bar and the second metallic connector is a metallic wire.

15. A switch unit for a circuit breaker comprising:

a first switch contact;

a second switch contact, wherein the first switch contact is movable between a first position in which the first switch contact contacts the second switch contact and a second position in which the first and second switch contacts are separated from each other;

a positioning element to position an arc chute on the switch unit, wherein the arc chute comprises at least two stacks of a plurality of substantially parallel metal plates;

a first connection device that electrically connects the first switch contact to a predetermined metal plate selected of a most proximal 25% metal plates of the first stack;

a second connection device capable to electrically connect the second switch contact to a predetermined metal plate selected of the most proximal 25% metal plates of the second stack;

a first horn electrically connected to the first switch contact, wherein the first switch contact is adapted to guide a first foot of an electric arc to the arc chute; and a second horn electrically connected to the second switch contact adapted to guide a second foot of the electric arc to the arc chute, wherein the second end of the first horn and the second end of the second horn are biased in the direction of the stacks of the arc chute adapted to be mounted on the switch unit.

* * * * *